US005353972A

United States Patent [19]

Mandel

[11] Patent Number: 5,353,972

[45] Date of Patent: Oct. 11, 1994

[54] METHOD AND APPARATUS FOR INSERTING A DRAWSTRING

[76] Inventor: Jack Mandel, 4511 Chesapeake St., NW., Washington, D.C. 20016

[21] Appl. No.: 70,928

[22] Filed: Jun. 4, 1993

[51] Int. Cl.[5] ..... A41H 43/00; D05B 85/00

[52] U.S. Cl. ..... 223/50; 223/103; 223/105

[58] Field of Search ..... 223/50, 105, 103, 48, 223/99; 24/34, 117, 140, 143, 266; 29/241; 112/121.19

[56] References Cited

U.S. PATENT DOCUMENTS

| | | | |
|---|---|---|---|
| Re. 16,926 | 4/1928 | Lippard . | |
| 683,946 | 10/1901 | Kops . | |
| 1,497,184 | 6/1924 | Mitchell . | |
| 2,058,994 | 10/1976 | Klahre | 223/50 |
| 2,064,239 | 7/1952 | Thomas | 223/50 |
| 2,601,037 | 6/1952 | Liebowitz . | |
| 2,610,777 | 9/1952 | Harris . | |
| 2,763,410 | 9/1956 | Walker . | |
| 3,688,379 | 9/1972 | Davis et al. . | |
| 4,671,437 | 6/1987 | Sauger . | |

FOREIGN PATENT DOCUMENTS

| | | | |
|---|---|---|---|
| 707989 | 12/1930 | France | 223/50 |
| 253458 | 11/1948 | Switzerland | 223/50 |

*Primary Examiner*—Clifford D. Crowder
*Assistant Examiner*—Larry D. Worrell, Jr.
*Attorney, Agent, or Firm*—Rothwell, Figg, Ernst & Kurz

[57] ABSTRACT

A method and apparatus for inserting a drawstring into garments or articles having a hem or channel for receiving the drawstring. The apparatus includes a resilient, hollow tubular member which receives the drawstring in a secure fashion so that it can be threaded into the channel of the garment. A method of inserting a drawstring includes attaching the string to the hollow member so as to be sheathed therein, placing both elements in the channel and threading the same completely therethrough, and then removing the hollow member from the drawstring.

7 Claims, 2 Drawing Sheets

METHOD AND APPARATUS FOR INSERTING A DRAWSTRING

BACKGROUND OF THE INVENTION

1. Field of the Invention

The present invention relates to apparatus and methods for inserting drawstrings into clothing apparel or other articles which have a channel or hem in which the drawstring is disposed to facilitate tightening or closing of the apparel or articles.

2. Description of the Related Art

It is known in the art to secure a device to a drawstring and then insert the device and drawstring into an opening in the hem or channel of a garment, e.g., a sweatshirt or sweatpants, and then manipulate the device within the garment to thread the drawstring through and out of the same or another opening in the garment. These devices serve to permit restringing of a drawstring that has been accidentally removed from the channel or hem. See, e.g., U.S. Pat. No. 4,671,437 to Sauger.

Known devices for accomplishing such restringing have heretofore been inadequate in securely attaching the drawstring to the device, or they have been relatively cumbersome in that they include several specialized parts which must be assembled together. For example, the device disclosed in the patent referenced above includes a stringing rod having a V-shaped notch cut in its one end and a mating conically shaped tip. In devices like this, the specially constructed components increase the overall cost of manufacturing, packaging, etc.

Accordingly, it is an object of the present invention to provide a method and apparatus for inserting drawstrings that is free of the aforementioned problems.

SUMMARY OF THE INVENTION

The present invention provides a method and apparatus for inserting drawstrings or cords into the hem or channel of garments, e.g., a sweatshirt, sweatpants, a swimsuit, etc., or articles, e.g., duffle bags. A hollow tubular member is provided which member has a longitudinal slit running along its length. The end of a drawstring, which typically has a plastic sleeve-like tip (an aglet) around it, is inserted into the member by forcing the slit apart with the plastic tip. The tip is then moved along the member until the drawstring, i.e., the cord or lace portion of the drawstring between the plastic tips at each end thereof, is fully sheathed in the hollow tubular member.

The drawstring and hollow member are inserted into the hem or channel together and are manipulated through the channel until the drawstring is fully threaded in the garment or article.

BRIEF DESCRIPTION OF THE DRAWINGS

Additional advantages of the present invention will be apparent to one skilled in the art upon reading the following description of a preferred embodiment thereof taken in conjunction with the accompanying drawings; wherein.

DETAILED DESCRIPTION OF THE PREFERRED EMBODIMENTS

Figure 1:
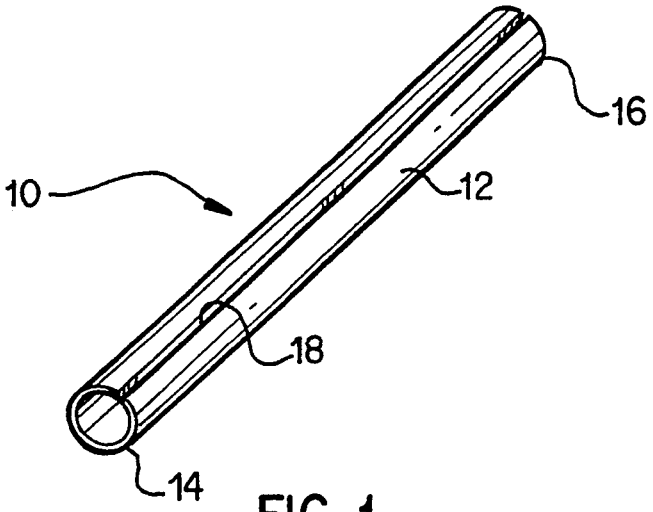
FIG. 1 is a perspective view of a drawstring inserting apparatus according to the present invention.

With reference to FIG. 1, an apparatus for inserting a drawstring into a garment or article is indicated generally at 10 and includes a hollow tubular member 12 with opposite ends 14, 16 and a longitudinal slit 18. The hollow member 10 is manufactured by an extrusion process from a resilient material such that the slit 18 can be forced open, but the inherent resiliency of the member 10 opposes opening of the slit. Examples of suitable materials include polyethylene and polypropylene. While hollow member 10 is shown as having a circular cross-section, it will be appreciated that it can take various other shapes in cross-section, for example but not limited to, square, rectangular, or triangular.

Figure 2:
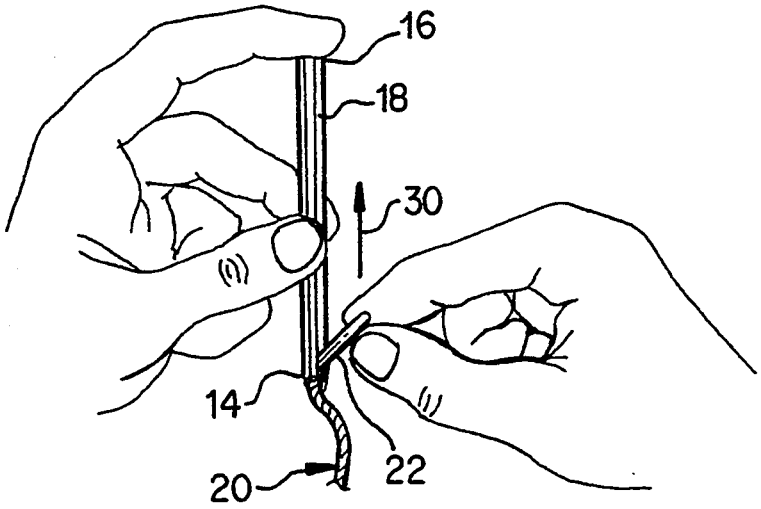
FIG. 2 is perspective view showing the drawstring being secured to the apparatus of FIG. 1.

FIG. 2 shows how drawstring 20 is secured to hollow member 10. Drawstring 20 includes a plastic tip or sleeve-like member 22 at each end as is conventional. To insert the drawstring into hollow member 10, this tip 22 is pushed into slit 18 at one end 14 of member 10 with sufficient force to spread the slit 18 apart. As seen in FIG. 2, a portion of the tip 22 projects through the slit 18 and remains outside the hollow member 10. This remaining portion is grasped as indicated and moved relative to member 10 towards the other end 16 in the direction of arrow 30. See FIG. 2.

The drawstring 20 is drawn into the central lumen or passage of member 10 as tip 22 is moved towards end 16. Upon reaching end 16, tip 22 is moved out of slit 18, at which time slit 18 closes (or attempts to close), leaving the cord portion 24 of drawstring 20 fully sheathed in hollow member 10. The drawstring is securely attached to member 10 due to the resiliency of the latter which causes it to surround and grasp cord portion 24. This enables insertion and manipulation of the drawstring 20 and hollow member 10 as a unit as will be described below.

The attachment of the cord portion 24 of drawstring 20 to member 10 is enhanced by the fact that the diameter of passage within member 10 is smaller than that of cord portion 24, which size difference serves to frictionally secure the two elements together. It will be recognized that it is possible to securely fasten the drawstring to the hollow member through a frictional engagement without relying on the resiliency of the hollow member. In other words, an adequate attachment can be obtained by simply utilizing a hollow member which is substantially smaller in diameter than the cord portion so that when the latter is forced into the former, friction secures them together. In this case, a non-resilient member 10 could be used. Furthermore, while the opposed edges of the hollow member 10 preferably abut at slit 18 when a drawstring is not disposed therein, it will be appreciated that the opposed edges can overlap due to the inherent resiliency of member 10. In either case, the plastic tip 22 of the string is preferably used to spread these edges apart to insert the drawstring 20.

Figure 3:
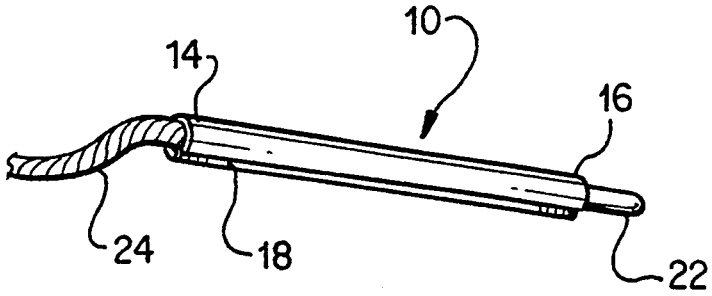
FIG. 3 is a perspective view of the apparatus of FIG. 1 with the drawstring fully sheathed therein.
Figure 4:
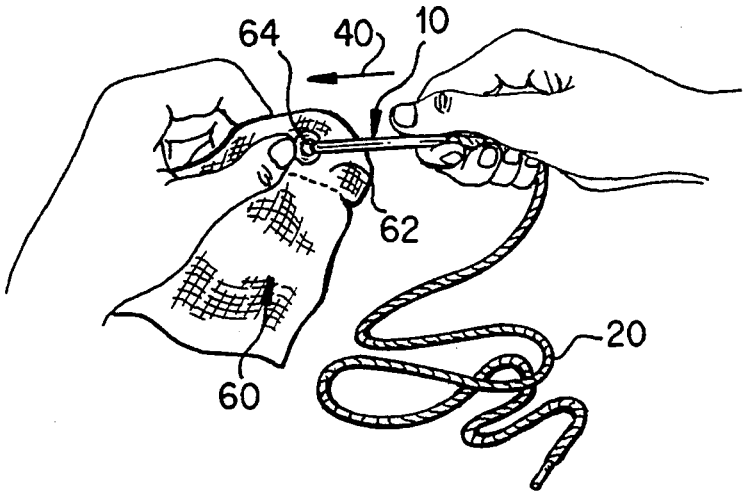
FIG. 4 is a perspective view showing the apparatus and drawstring of FIG. 3 being inserted into the channel of a garment or article.

After the hollow member 10 and drawstring 20 have been secured together, as shown in FIG. 3, they are placed through opening or eyelet 64 into hem or channel 62 of garment 60 as indicated by arrow 40 in FIG. 4. As seen in FIG. 3, the tip 22 of drawstring 20 is preferably partially within the end 16 of member 10 when fully inserted therein. While item 60 is referred to as a garment, it will be recognized that such designation is for exemplary purposes only and that item 60 can be any article of clothing, a duffle bag, a pouch, or any other item in which a drawstring is used. Further, while only one eyelet 64 is shown, it will be apparent that the present invention can be used with garments having two eyelets through which each end of the drawstring respectively extends.

Figure 5:
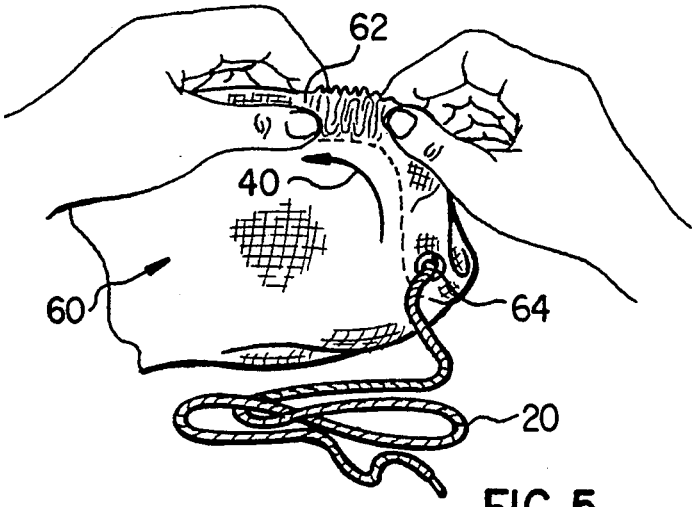
FIG. 5 is a perspective view showing the apparatus and drawstring being manipulated within the garment or article to thread the drawstring therethrough.
Figure 6:
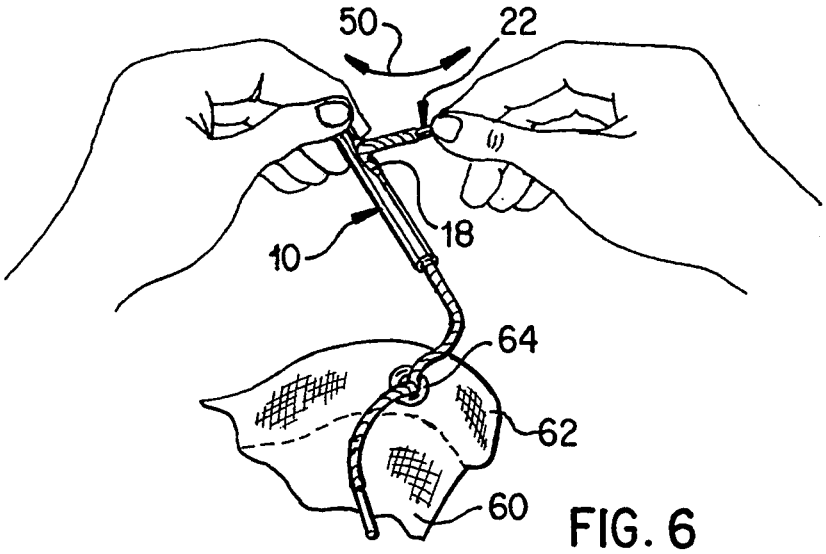
FIG. 6 is a perspective view showing the apparatus and drawstring threaded through and out of the garment or article with the apparatus being removed from the drawstring.

FIG. 5 shows the manipulation of the member 10 and drawstring 20 as they are threaded through channel 62 of garment 60. This threading aspect of the present invention will not be described in detail as it is apparent how it is carried out. Upon reaching the end of channel 62, the member 10 and drawstring 20 are pushed out of garment 60 through eyelet 64. The drawstring 20 then is removed from hollow member 10 by pulling tip 22 back through slit 18 while moving member 10 in an opposite direction, as shown by arrow 50 in FIG. 6. The hollow member 10 is then ready to be reused when needed.

Other features and advantages of the present invention will readily occur to those skilled in the art, as will many modifications and alterations in the preferred embodiment of the invention described herein, all of which may be achieved without departing from the spirit and the scope of the invention.

What is claimed is:

1. A method for inserting a drawstring into an article having a channel for the drawstring, the drawstring being operable to vary the size of an entry opening formed in the article, the method comprising the steps of:

providing a drawstring inserting device including a hollow elongated member having two ends and a central passage with a longitudinal slit extending substantially over the length of the hollow member, the hollow member composed of a material which is resilient so that force can be applied to spread the member apart at the longitudinal slit and the member will resist the spreading force;

placing a tip end of a drawstring adjacent one end of the hollow member and forcing the tip end of the drawstring into the longitudinal slit at said one end of the hollow member;

moving the drawstring adjacent one end of the hollow member while grasping the tip end of the drawstring such that a portion of the drawstring adjacent the tip end is pulled into said passage within the hollow member;

placing said tip end of the drawstring adjacent the other end of the hollow member with said portion of the drawstring sheathed in the passage;

inserting the combination of the drawstring and the drawstring inserting device into one end of the channel of the article and moving said combination within said channel in the article until the combination has been passed through the length of the channel and out another end of the channel; and removing the drawstring inserting device from the drawstring while leaving the drawstring in said channel to permit the drawstring to be operated to vary the size of said entry opening in the article.

2. A method for inserting a drawstring into an article having a channel for receiving the drawstring, the drawstring being operable when received in the channel to vary the size of an entry opening formed in the article, the method comprising the steps of:

providing a drawstring inserting device including a hollow tubular member having two ends and a central passage with a longitudinal slit extending substantially over the length of the hollow member, the hollow member being composed of a material which is resilient so that force can be applied to spread the member apart at the longitudinal slit and the member will resist the spreading force;

positioning a drawstring having a cord portion in the hollow tubular member such that at least some of the cord portion of the drawstring is sheathed within the hollow member so as to be frictionally retained therein;

inserting the combination of the drawstring and the drawstring inserting device into one end of the channel of the article and moving said combination within said channel in the article until the combination has been passed through the length of the channel and out another end of the channel; and removing the drawstring inserting device from the drawstring while leaving the drawstring in said channel to permit the drawstring to be operated to vary the size of said entry opening in the article.

3. A drawstring restringing kit for facilitating the placement of a drawstring into an article having a channel configured to receive the drawstring therethrough such that the drawstring extends through the channel and outside the article, the drawstring serving to vary the size of an entry opening formed in the article adjacent said channel, the kit comprising:

a hollow tubular member including a sleeve having a longitudinal slit extending substantially over its entire length;

said hollow member having means for receiving an end of a drawstring within the longitudinal slit with an end of the drawstring extending at least partly outside the hollow member such that the drawstring end can be grasped and pulled along the hollow member to sheath a portion of the drawstring within the hollow member in a snug manner; and a drawstring having a portion configured to be sheathed in said hollow tubular member;

whereby the combination of the drawstring and the hollow tubular member may be inserted into said channel of the article and moved therein to thread the drawstring through the channel, the hollow tubular member removed from the drawstring, and the drawstring manipulated to vary the size of the entry passage formed in said article.

4. The method according to claim 1, wherein the step of placing said drawstring end adjacent the second member end of the hollow member includes passing said drawstring end through the longitudinal slit and into the passage so that the drawstring end extends out of the second member end of the hollow member.

5. A combination according to claim 1, wherein the means for maintaining the drawstring within the hollow member includes forming the hollow member of a resilient material so that it remains biased around the drawstring.

6. A combination according to claim 3, wherein the means for maintaining the drawstring within the hollow member includes the drawstring being larger than the interior of the hollow member such that the drawstring can be forced into the member but will not move freely within the hollow member.

7. A combination according to claim 3, wherein said longitudinal slit extends over the entire length of said hollow member.

* * * * *